US009033174B2

(12) United States Patent
Chasteen et al.

(10) Patent No.: US 9,033,174 B2
(45) Date of Patent: May 19, 2015

(54) EASY ACCESS OPENING TAB FOR A CONTAINER END CLOSURE

(71) Applicant: Ball Corporation, Broomfield, CO (US)

(72) Inventors: Howard C. Chasteen, Westminster, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 13/838,478

(22) Filed: Mar. 15, 2013

(65) Prior Publication Data

US 2014/0263329 A1 Sep. 18, 2014

(51) Int. Cl.

| | |
|---|---|
| ***B65D 17/34*** | (2006.01) |
| ***B65D 17/00*** | (2006.01) |
| *B65D 43/26* | (2006.01) |

(52) U.S. Cl.

CPC ..... *B65D 17/165* (2013.01); *B65D 43/26* (2013.01); *B65D 2517/0014* (2013.01); *B65D 2517/0073* (2013.01)

(58) Field of Classification Search

CPC ..... B65D 17/165; B65D 43/26; B65D 2517/0014; B65D 2517/0073

USPC ..... 220/269, 906; 413/12, 14, 16

See application file for complete search history.

(56) References Cited

U.S. PATENT DOCUMENTS

| | | | | |
|---|---|---|---|---|
| 3,250,425 | A | | 5/1966 | Stec et al. |
| 3,554,400 | A | | 1/1971 | Bozek |
| 3,625,392 | A | | 12/1971 | Kaminski |
| 3,938,696 | A | * | 2/1976 | Herbst ..... 220/273 |
| 3,986,633 | A | | 10/1976 | Jordan |
| 4,015,744 | A | | 4/1977 | Brown |
| 4,024,981 | A | | 5/1977 | Brown |
| 4,030,631 | A | | 6/1977 | Brown |
| 4,051,976 | A | | 10/1977 | Perry |
| 4,084,721 | A | | 4/1978 | Perry |
| 4,093,102 | A | * | 6/1978 | Kraska ..... 220/623 |
| 4,105,134 | A | | 8/1978 | Debenham et al. |
| 4,257,529 | A | | 3/1981 | Saunders |
| 4,266,688 | A | * | 5/1981 | Reid ..... 220/273 |
| D265,463 | S | | 7/1982 | Hasegawa |
| 4,465,204 | A | | 8/1984 | Kaminski et al. |

(Continued)

FOREIGN PATENT DOCUMENTS

| | | |
|---|---|---|
| EP | 0381888 | 8/1990 |
| EP | 1919786 | 9/2009 |

(Continued)

OTHER PUBLICATIONS

International Search Report and Written Opinion for International (PCT) Patent Application No. PCT/US14/18860 mailed Apr. 22, 2014, 10 pages.

*Primary Examiner* — Fenn Mathew
*Assistant Examiner* — James N Smalley
(74) *Attorney, Agent, or Firm* — Sheridan Ross P.C.

(57) ABSTRACT

An end closure for food and beverage containers is provided. The end closure comprises a central panel portion having a protuberance for facilitating access to and manipulation of a pull tab. Before the food or beverage container is pressurized, the protuberance is substantially flat to improve stacking and conveying of the end closure. After the food or beverage container is filled and pressurized, the protuberance selectively deflects and lifts a tail portion of the pull tab to facilitate access.

20 Claims, 7 Drawing Sheets

(56) References Cited

U.S. PATENT DOCUMENTS

| | | | |
|---|---|---|---|
| 4,524,879 | A | 6/1985 | Fundom et al. |
| 4,530,631 | A | 7/1985 | Kaminski et al. |
| 4,930,658 | A | 6/1990 | McEldowney |
| 4,994,009 | A | 2/1991 | McEldowney |
| 5,129,541 | A | 7/1992 | Voigt et al. |
| 5,131,555 | A | 7/1992 | DeMars et al. |
| D337,521 | S | 7/1993 | McNulty |
| 5,224,618 | A | 7/1993 | Garbiso |
| 5,335,808 | A | 8/1994 | Lee |
| 5,590,993 | A | 1/1997 | Saunders |
| 5,655,678 | A | 8/1997 | Kobayashi |
| 5,680,952 | A | 10/1997 | Chasteen |
| 5,711,448 | A | 1/1998 | Clarke, III |
| 5,813,561 | A | 9/1998 | Chang et al. |
| 5,813,811 | A | 9/1998 | Saunders |
| D419,873 | S | 2/2000 | Piccione |
| 6,074,736 | A | 6/2000 | Kagawa |
| 6,138,856 | A | 10/2000 | Ghim et al. |
| 6,164,480 | A | 12/2000 | Heinicke et al. |
| 7,168,586 | B2 | 1/2007 | Jeon |
| D579,771 | S | 11/2008 | Cherian |
| D600,116 | S | 9/2009 | Cherian |
| 7,594,585 | B1 | 9/2009 | Fields |
| D602,776 | S | 10/2009 | Cherian |
| 7,617,945 | B2 | 11/2009 | Cherian |
| D612,724 | S | 3/2010 | Cherian |
| 7,891,519 | B2 | 2/2011 | Matsukawa et al. |
| 7,909,196 | B2 | 3/2011 | Turner et al. |
| 7,926,675 | B2 | 4/2011 | Rieck et al. |
| 7,942,285 | B2 | 5/2011 | Hasegawa et al. |
| 8,177,092 | B2 | 5/2012 | Mills |
| 8,196,767 | B2 | 6/2012 | Fields |
| 2002/0108954 | A1 | 8/2002 | Cho |
| 2004/0056032 | A1 | 3/2004 | Vaughan |
| 2005/0224497 | A1 | 10/2005 | Wook |
| 2005/0284869 | A1 | 12/2005 | Mills |
| 2007/0108208 | A1 | 5/2007 | Dickie |
| 2007/0108209 | A1 | 5/2007 | Jeon |
| 2008/0099480 | A1 | 5/2008 | Chang |
| 2008/0197132 | A1 | 8/2008 | Hasegawa et al. |
| 2010/0326281 | A1 | 12/2010 | Nishibe et al. |
| 2011/0139782 | A1 | 6/2011 | Cherian |
| 2011/0253719 | A1 | 10/2011 | Cherian |
| 2011/0308202 | A1 | 12/2011 | Hall |
| 2012/0193361 | A1 | 8/2012 | Jeon |
| 2013/0043248 | A1 | 2/2013 | Frank |

FOREIGN PATENT DOCUMENTS

| | | |
|---|---|---|
| JP | 05-075935 U | 10/1993 |
| JP | 08-000580 U | 4/1996 |
| JP | H10-59362 | 3/1998 |
| JP | 2000-159229 | 6/2000 |
| JP | 2002-145263 | 5/2002 |
| JP | 2002-362553 | 12/2002 |
| WO | WO 2011/107558 | 9/2011 |

* cited by examiner

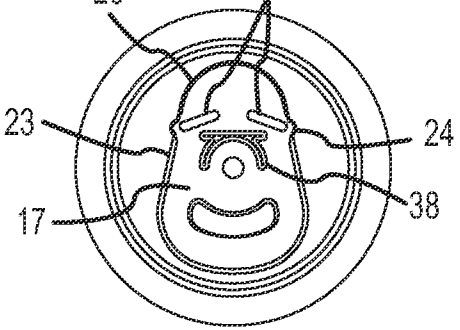
FIG.8
FIG.9
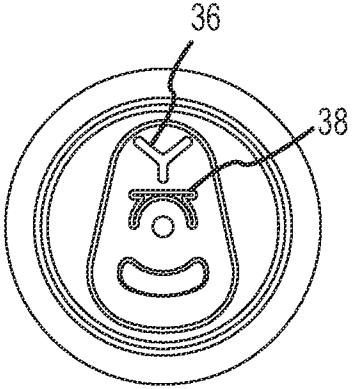
FIG.10
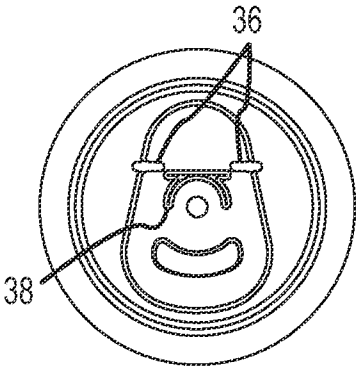
FIG.11
FIG.12
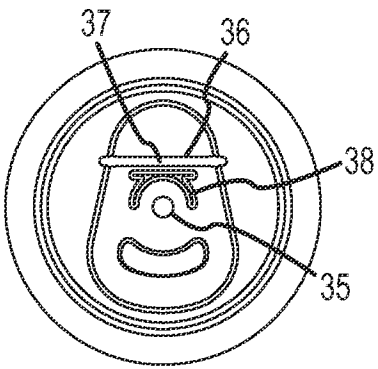
FIG.13

EASY ACCESS OPENING TAB FOR A CONTAINER END CLOSURE

FIELD OF THE INVENTION

Embodiments of the present invention generally relate to containers and container end closures, and more specifically metallic beverage container end closures with easy access opening tabs.

BACKGROUND OF THE INVENTION

Containers, and more specifically metallic beverage containers, generally contain a neck on an upper portion that is adapted for interconnection to a metallic end closure. The container end closure is formed from a flat sheet of metallic material and generally includes a pull tab or other form of stay on tab ("SOT"). Beverage containers commonly store carbonated beverages, thus, both the container body and the container end closure are required to withhold internal pressures up to 90 psi without catastrophic failure or permanent deformation. Further, the container end closure must be manufactured, stacked, shipped, and sent to a filler prior to being seamed onto a container body filled with a carbonated beverage. Thus, the container and end closure must be designed to resist deformation and failure while utilizing thin metallic materials and allowing compact stacking during shipping and manufacturing.

Food and beverage containers with pull tabs or SOTs are generally known. Various SOTs and related features are disclosed, by way of example, in U.S. Pat. No. 7,926,675 to Rieck et al., the entire disclosure of which is hereby incorporated by reference in its entirety. Known devices, however, generally position a distal or "tail" end of a pull tab in close proximity to the panel of the end closure to allow stacking of the end closures prior to and after filling of the beverage container. Such an arrangement, particularly where can contents are placed under pressure, pose various complications and challenges with operating the tab and opening a portion of the panel. Such complications include, but are not limited to difficulty in engaging or grasping the tab and risks of damage or injury to a user's finger(s) or fingernail(s).

Some consumers, especially children, the elderly, and people with long and/or artificial finger nails, have difficulty opening beverage containers with SOTs because they cannot raise the tab lift ring in order to break the score line with the tab nose. The problem often arises from the lack of space between the lift ring (also called a tab tail) and the central panel of the end closure. In the past, there has been a very limited amount of end closure modifications to allow the consumer adequate room to fit his/her finger under the lift ring for easier opening. This is because during the manufacturing process finger access modifications are a problem for a variety of reasons, including: stacking, conveying, palletizing, metal exposure, rotated tabs, and "tab-over-chime" issues. "Tab-over-chime" refers to a geometry where the pull tab is located above the height of the peripheral curl the container end closure, which creates stacking problems, potential damage and increased expenses.

Furthermore, conveying end closures at high speeds depends on the end closures tightly nesting together so that they can flow smoothly along a track from process to process (e.g., shell formation, conversion, bagging and filling, etc.). Any modification that elevates the tab higher on the central panel or the central panel on the end to protrude downward, causes stacking interference. Stacking interference may allow the end closures to snake around and compress like a spring. Conveying spongy end closures causes jams in the conveying track and during other processes. Accordingly, there exists a significant need for a beverage container end closure with an easy access tab that can be efficiently stacked and conveyed during manufacturing and shipping, yet which is manufactured with durable, lightweight, reduced gage metallic materials in a traditional manner, and that improves the opening characteristics for the consumer.

Previous attempts have been made to manufacture container end closures with adequate room to accommodate a consumer's finger under the lift ring in an attempt to provide easier opening for the consumer. Many of these attempts include a container lid with one or more upwardly extending protrusions such that the user can rotate the tab onto a protrusion and either break the scored area or gain additional space for the consumer's finger under the tail of the tab. See, e.g., U.S. Pat. No. 3,250,425 to Stec et al; U.S. Pat. No. 5,131,555 to DeMars et al; U.S. Pat. No. 5,224,618 to Garbiso; U.S. Patent Application Publication No. 2002/0108954 to Cho; and Japanese Utility Model No. 05075935U, which are each incorporated by reference herein in their entireties. Further, U.S. Pat. No. 5,335,808 to Lee ("Lee") discloses a container lid with a nose end of a tab initially resting on an upwardly extending protrusion and a tail end of the tab lying flat against the container lid. A user may depress the protrusion and nose end of the tab into the container and cause the tail end of the tab to rise, making it easier for a user to open the container. The entire disclosure of Lee is incorporated by reference herein in its entirety.

Other attempts to provide an end closure that is more easily opened include container lids with concave central panels. Concave central panels can make stacking and conveying more difficult. Therefore, certain end closure designs utilize a central panel that "dome out" or become concave after pressurization. For example, U.S. Pat. No. 7,909,196 to Turner et al. ("Turner") discloses an end closure having a tab with a downward facing protrusion (e.g., a curled edge of the tab) in contact with a central panel that "domes" outward when the container is pressurized such that the lift ring (i.e., tab tail) is elevated above the central panel. Additionally, U.S. Patent Publication No. 2010/0326281 to Nishibe et al. ("Nishibe") discloses a container lid where the lid and tab are bent downward before pressurization. After the container lid is affixed to a container and the container is pressurized, the bent lid and tab rise upwards, such that the center point of the container lid is the maximum concave portion, to create space under the tail end of the tab. The entire disclosures of Turner and Nishibe are incorporated by reference herein in their entireties.

U.S. Pat. Nos. 7,168,586 and 8,113,375 to Jeon ("the Jeon '586 patent" and "the Jeon '375 patent" respectively) disclose a container lid with an upwardly extending, deformable protrusion. A user applies a manual force to the downwardly deformable protrusion to create a concave section under the tail end of the tab. The entire disclosures of the Jeon '586 patent and the Jeon '375 patent are incorporated by reference herein in their entireties.

U.S. Pat. No. 7,617,945 to Cherian ("Cherian") discloses a container lid that has a bent tab such that when a user presses the nose end of the tab downwards, the tail end of the tab rises upward. Cherian also discloses a container lid where a user may rotate the tab up onto upwardly extending protrusions to raise the tail end of the tab. Cherian further discloses a container lid with a simple depression under the tail end of the tab. The entire disclosure of Cherian is incorporated by reference herein in its entirety.

Japanese Application No. 2002-362553 to Omura ("Omura") discloses a container lid with a "seesaw"-shaped tab. A user may depress the nose end of the tab and raise the tail end of the tab, providing space so that a user may easily lift the tab and open the container. The entire disclosure of Omura is incorporated by reference herein in its entirety.

U.S. Pat. No. 8,177,092 to Mills ("Mills"), issued May 15, 2012, discloses a container lid which has two sets of scored lines such that opening the container is a two-stage process. As a user begins to lift the tab, the first scored line fractures and releases pressure from within the container. Then, the user further lifts the tab to fracture the second scored line and open the container. This two-stage process prevents the internal pressure of the container from turning the container lid into a missile. The entire disclosure of Mills is incorporated by reference herein in its entirety.

U.S. Pat. No. 5,655,678 to Kobayashi ("Kobayashi") issued on Aug. 12, 1997, and discloses a device for opening a container where a tab interconnects to a rivet via a separate element. This separate element allows a user to lift the tab a certain distance before the tab actually engages the container to fracture a scored area. The entire disclosure of Kobayashi is incorporated by reference herein in its entirety.

Due to the numerous limitations associated with the prior art described above, the following disclosure describes an improved container end closure that is adapted for interconnection to a container body and that employs a protuberance to slightly lift a tab. This novel feature provides an improved access area for a consumer's finger and significantly improves the ease of opening the container.

SUMMARY OF THE INVENTION

These and other needs are addressed by the various embodiments and configurations of the present invention. This disclosure relates to a novel system, device, and methods for providing a food and beverage container end closure with an easy access opening tab. The novel end closure provided herein allows the end closure to remain flat and thus easily stackable throughout the manufacturing and filling processes. After filling the container with a product, $CO_2$ causes internal pressurization and the protuberance under the tab rises upward to lift the tail of the SOT for improved finger access.

Features of the present disclosure may be employed in a wide range of food and beverage containers, including pressurized beverage containers with SOTs secured by a rivet, food containers with tear away lids, and full panel easy-open end tabs, to name a few. Although the invention generally relate to metallic end closures and containers, the invention and features described herein could easily be implemented on plastic containers and end closures.

In an attempt to decrease material costs and improve strength, end closure engineers design the central panel proximate to the upper portion of the peripheral curl, which can result in performance issues. More specifically, container end closures with a raised central panel height may experience problems associated with tab-over-chime. Tab-over-chime refers to a geometry where the pull tab is located above the height of the end closure peripheral curl, which creates stacking problems and thus potential damage during shipping and increased expenses. Thus, it is a challenge to design an end closure with an easy access lift tab that can be easily stacked and conveyed during manufacturing and shipping and also maintain enhanced buckling and deformation properties.

Many users of conventional devices, such as SOTs for pressurized containers, have difficulty performing various opening functions. Opening of containers may be frustrated by, for example, difficulty in accessing the underside of a tab, pressure being applied to sensitive areas of one's fingertip, and breakage of fingernails. A significant cause of such frustrations lies in the fact that many known end closures comprise a tab that rests flush against the end panel, particularly when container contents are under pressure. The present invention provides for a plethora of improvements over known devices. End closures of the present disclosure provide, for example, the structural features and benefits, stacking abilities, and ease of manufacture of various known devices. Further, end closures of the present disclosure provide a protuberance that, after pressurization, pushes the tab tail upward and away from the central panel allowing for ease of access to the operative (i.e., bottom) side of the tab, thereby increasing user-friendliness of the device.

Thus, it is thus one aspect of various embodiments of the present invention to provide a metallic end closure with improved tab access that has a relatively flat profile to allow stacking, nesting, and traditional bagging and filling. After filling and double seaming, the $CO_2$ in the beverage creates sufficient pressure in the container to cause upward movement of a preformed protuberance in the central panel to elevate the pull ring portion of the pull tab to provide improved finger access.

It is thus one aspect of various embodiments of the present invention to provide an easy-access end closure with advantages over the prior art. One advantage of some embodiments is that an interrupted deboss allows the tab to remain flat during the manufacturing process. However, when the end closure is seamed on to a container and the container has been pressurized, the area of the interrupted deboss allows the panel to rise upward exposing the tail of the tab for easier consumer access.

It is a further aspect of embodiments of the present invention to provide a container end closure with a protuberance in the central panel that expands upwardly from the central panel to lift the tail end of the tab. This aspect of embodiments of the present invention utilizes an upwardly expanding protuberance, not a downwardly expanding protuberance.

It is another aspect of the present invention to provide a container end closure with an end closure that utilizes a protuberance located on the central panel and below the tab. In some embodiments, before the end closure is seamed onto a container body, the end closure and tab are oriented in a substantially horizontal plane, which permits optimized stacking and conveying characteristics. Further, the access space underneath the tab tail is relatively small. When the end closure is seamed to a container body and the carbonated product is added, the head space below the end closure is pressurized. In one embodiment, the increased pressure in the container creates a force below the protuberance such that the protuberance deflects upwardly to raise the tail of the pull ring and increase access for a user's finger. In another embodiment, this pressure causes the protuberance underneath the tab to upwardly extend and drive the tab tail upwards, but still positioned below chime. In this pressurized state, the access space underneath the tab tail is increased and allows for an entry area for a consumer's finger and easier opening of the end closure.

Another aspect of the present invention is a method for manufacturing an end closure with a protuberance. More specifically, a method for forming a beverage can end closure is provided, wherein the container end closure is provided with access space under the tail of the pull tab. In some embodiments, the end closure may have a protuberance that, when deflected, pushes the tail of the tab upward. The end closure may also comprise a fingerwell under the tail of the tab, such as the fingerwell described in U.S. patent application Ser. No. 13/588,843 and U.S. Provisional Patent Application No. 61/525,574, the entire disclosures of which are hereby incorporated herein by reference in their entireties.

In another aspect of the present invention, a container end closure is provided that is manufactured with conventional manufacturing equipment. In some embodiments, the protuberance is formed uses forms, coins (e.g., thinning), or a combination of forms and coins to create a weakened area. The weakened area has slack metal (the protuberance slack area) that under pressurization lifts the contact area, which bulges upward lifting the tail of the tab.

In various embodiments, an end closure is provided with a SOT and a protuberance in the panel. In some embodiments, the protuberance may be disposed generally proximal to a rivet, and on the same public side of the rivet. In a preferred embodiment, the protuberance is positioned approximately halfway between a tail of the pull ring and the rivet such that the protuberance is positioned below the pull tab and lifts the pull ring tail. The closer the protuberance is to the rivet, the more the pull ring tail lifts. In one embodiment, the protuberance is disposed such that at least a portion of the tab tail extends over at least a portion of a deboss area in the central panel and facilitates user-access to an underside of the tab for lifting.

In one embodiment, an end closure with a protuberance is provided, the protuberance having a generally rounded shape when viewed from a top plan view. In some embodiments, the protuberance may be circular. In other embodiments, the protuberance may be oval-shaped, rectangular, or any other shape. In various embodiments, a deflected protuberance after pressurization is provided having a height of between approximately 0.060 and 0.020 inches as measured from the central panel, or more specifically as measured from the deboss area of the central panel. In a preferred embodiment, a protuberance is provided having a height of between approximately 0.050 and 0.030 inches as measured from the panel. In a more preferred embodiment, a protuberance is provided having a height of approximately 0.040 inches as measured from the panel.

In various embodiments, an end closure with a protuberance and improved geometry is provided to allow access to a pull tab and provide for increased normal force to be imparted upon the pull tab. For example, the present invention contemplates the provision of a protuberance that tilts a tail of the pull tab upward allowing a user access to the pull tab and allowing for greater normal force to be applied to the pull tab when compared with known devices. It is known, for example, that existing pull tabs are not only difficult to access but further result in a significant amount of the force being applied to the pull tab in a direction or vector parallel with an opening area. Such a force places stress upon a rivet and provides reduced ability to score or open an opening area. Protuberances of various embodiments of the present invention allow for a user to provide an initial force upon the tab with an increased degree of normal force, further facilitating opening operations.

Furthermore, the improved end closure allows the stacking and conveying of multiple end closures during production and shipping. Because the tab generally remains below the chime, even after pressurization, the end closure also allows the stacking of filled food or beverage containers.

In one embodiment, a container end closure adapted for interconnection to a container body is provided. The end closure comprises: a peripheral curl, a chuck wall, a countersink having an outer panel wall and an inner panel wall, a central panel, a pull tab, and a deflectable protuberance positioned on the public side of the end closure.

In one embodiment, an end closure for a beverage container with an improved access pull tab is provided. The end closure comprises: a peripheral curl adapted for interconnection to a neck of the container; a chuck wall interconnected to the peripheral curl and extending downwardly therefrom; a countersink having an outer panel wall interconnected to a lowermost portion of the chuck wall and an inner panel wall; a central panel interconnected to the inner panel wall and oriented in a substantially horizontal plane and having a substantially vertical center axis; a pull tab interconnected to a public side of the central panel and including a lift ring and a nose on an opposite end of the lift ring, the nose positioned proximate to a frangible score line in the central panel which defines a pour opening; and a deflectable protuberance in the central panel which is positioned below the pull tab between the nose and the lift ring, the deflectable protuberance having a cross-sectional elevation substantially the same as the central panel in a first position and a raised cross-sectional elevation in a second position which elevates the lift ring of the pull tab to provide improved access for a user's fingers below the lift ring.

In one embodiment, a metallic beverage container with a dynamic stay on tab is provided. The metallic beverage container comprises: a container body having a closed lower end and an open upper end with a neck; a metallic end closure adapted for interconnection to the neck of the container, the metallic end closure having a substantially vertical center axis when viewed in cross-section, and oriented in a substantially horizontal plane when in a first position; a pull tab interconnected to a central panel of the metallic end closure and comprising a lift ring on one end and a nose on an opposite end, the nose positioned proximate to a frangible score line in the central panel, the frangible score line defining at least a portion of a pour opening; and a deflectable protuberance formed in the central panel and positioned below the pull tab between the lift ring and the nose, the deflectable protuberance extending upwardly to elevate the lift ring of the pull tab after at least one of a food and a beverage is placed in the container and the metallic end closure is interconnected to the neck of the container.

Various methods of forming an end closure with a protuberance are provided. In one embodiment, a method is provided comprising the steps of: providing a blank end panel, forming a rivet at a substantially central location on the end panel, coining the panel, providing one or more scores for an opening area, providing a debossed panel, providing a protuberance portion, and securing a pull tab.

Devices and methods of the present disclosure contemplate forming a protuberance portion on an end panel (i.e., central panel of an end closure) at various stages of panel formation. For example, a protuberance may be formed on an end panel before, during, or after formation of features such as debossed features, rivets, frangible score lines defining opening areas, etc. In one embodiment, a forming tool is provided to form a weakened area with a protuberance, while recessed portions of the tool accommodate various preformed features of the panel.

An opening operation of an end closure is additionally provided herein. A pull tab is initially provided in a closed state on an end closure. The end closure initially has a protuberance in a flat, first position. After the end closure is double-seamed onto a filled and pressurized container, the protuberance expands to a raised, second position. The raised protuberance lifts the pull tab tail to allow access to at least a portion of the tab such that a greater lifting or normal force may be applied to the lift ring of the tab. Accordingly, opening operations are facilitated by creating a greater corresponding downward normal force at the nose of the tab to sever a score line and/or force open an opening area. In this manner, embodiments of the present disclosure provide distinct advantages over known devices which require or result in a substantial amount of an initial force applied to a pull tab to be directed parallel to the panel. Whereas known devices do not maximize or achieve a normal force upon the pull tab and/or opening until a portion of opening operations are completed, the present invention provides for a greater application of perpendicular force to a pull tab when an opening area is in a completely closed state, as well as throughout opening operations.

In one embodiment, a method of forming and filling an improved access pull tab and container is provided. The method comprises: providing a container comprising a body having a closed lower end and an open upper end with a neck; providing an end closure comprising a pull tab interconnected to a central panel, a deflectable protuberance formed in the central panel and positioned below the pull tab, and a frangible score line defining a perimeter of an opening, the pull tab comprising a lift portion on one end and a nose on an opposite end, the nose oriented proximate to a frangible score line in the central panel; filling the container with a carbonated beverage; attaching the end closure to the neck of the container; increasing a pressure in the container to create a force below the deflectable protuberance; and expanding the deflectable protuberance upward to raise the lift portion of the pull tab.

For purposes of further disclosure, the following references generally related to end panels and SOTs are hereby incorporated by reference in their entireties: Japanese Patent Publication Number JP2002145263 to Yoshihiko and Japanese Patent Publication Number JP2000159229 to Yoshihiko.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Furthermore, the Summary of the Invention is neither intended nor should it be construed as being representative of the full extent and scope of the present invention. The present invention is set forth in various levels of detail in the Summary of the Invention, as well as in the attached drawings, the Detailed Description of the invention, and the Claims. No limitation as to the scope of the present invention is intended to either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

FIG. 8 is a top plan view (public side) of an embodiment of an end closure with a protuberance (shown without a tab);

FIG. 9 is a top plan view (public side) of an embodiment of an end closure (shown without a tab);

FIG. 10 is a top plan view (public side) of an embodiment of an end closure (shown without a tab);

FIG. 11 is a top plan view (public side) of an embodiment of an end closure (shown without a tab);

FIG. 12 is a top plan view (public side) of an embodiment of an end closure (shown without a tab); and FIG. 13 is a top plan view (public side) of an embodiment of an end closure (shown without a tab).

Figure 1A:
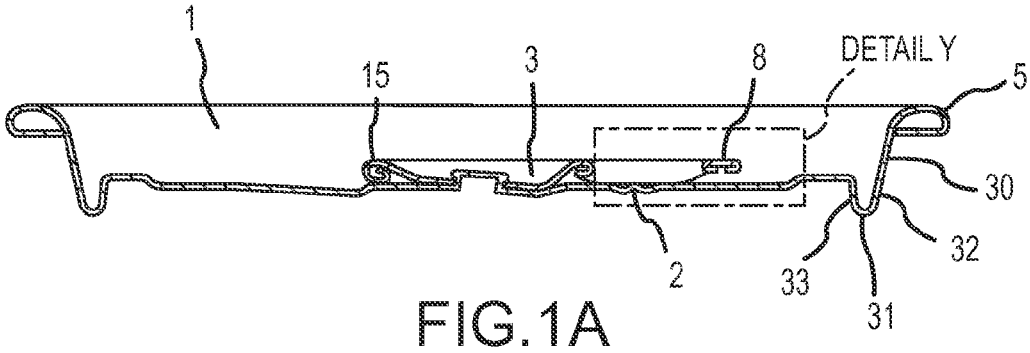
FIG. 1A is a cross-sectional front elevation view cross section of an end closure with a protuberance and a tab prior to double-seaming to a container.

To assist in the understanding of the embodiments of the present invention the following list of components and associated numbering found in the drawings is provided herein:

| No. | Component |
|---|---|
| 1 | Loose End Closure (non-pressurized) |
| 2 | Protuberance |
| 3 | Tab |
| 4 | Container Body |
| 5 | Peripheral Curl |
| 6 | Seam |
| 7 | Seamed End Closure (pressurized) |
| 8 | Tail of Lift Ring |
| 9 | Pressurized Product |
| 10 | Head Space |
| 11 | Protuberance Slack Area |
| 12 | Lift Ring Access Area (before pressurization) |
| 13 | Lift Ring Access Area (after pressurization) |

-continued

| No. | Component |
|---|---|
| 14 | Tab Contact Area |
| 15 | Tab Nose |
| 16 | Chime |
| 17 | Shadow Bead |
| 18 | Deboss Area |
| 19 | Central Panel |
| 20 | Lift Ring |
| 21 | Score Line |
| 22 | Pour Opening (after opened) |
| 23 | Deboss Angled Wall |
| 24 | Deboss Wall Interruption |
| 25 | Neck |
| 26 | Closed Lower End |
| 27 | Weakened Area |
| 30 | Chuck Wall |
| 31 | Countersink |
| 32 | Countersink Outer Panel Wall |
| 33 | Countersink Inner Panel Wall |
| 35 | Rivet (may be a centerline rivet) |
| 36 | Form |
| 37 | End Closure Contact Area |
| 38 | Cent Bead |
| 39 | Combination of Cent Bead and Form |
| 40 | Beverage Container (sealed & pressurized) |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the art and which can be modified in numerous ways within the scope and spirit of the invention.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein, the following terms and meanings are provided:

"Protuberance" refers to the expanding lift feature of the present disclosure. The protuberance may protrude, bulge, project, extend, pop up, etc. from any area of the central panel. The terms "dimple", "nipple", "deflectable protuberance", "tab tail lift feature", "tab lift feature", and "lift feature" may be used herein interchangeably with "protuberance."

"Weakened area" refers to the area of the central panel that includes the protuberance and surrounding slack area and which has certain physical characteristics that allow movement of a predetermined portion of the central panel and/or a protuberance section. The term "deboss interruption" may be used herein interchangeably with "weakened area."

"Tab tail" refers to the distal end of the pull tab, i.e., the end opposite the nose of the pull tab. The terms "tail", "pull tab tail", and "distal end" may be used herein interchangeably with "tab tail." "Pull ring" refers to a circular or ring-shaped portion located on a pull tab proximate the tab tail and/or opposite the tab nose. The pull ring generally comprises a ring portion located on a distal end of the pull tab. Thus, the pull ring tail, if there is one, is the most distal point of the pull tab and is located at the edge furthest from the nose. The term "lift ring" may also be used herein interchangeably with "pull ring."

"Height" has its normal meaning and may also refer to the cross-section elevation or distance from one point to another point, i.e., a vertical distance between a lower portion and an upper portion.

"Coins" and "coining" refer to the metalworking process known in the art. Coining may involve shaping metal by squeezing the metal between two dies. The sheet metal may have different shapes or designs on each side, thus creating differences in the thickness of the metal. Coining may be used to harden and/or shape the metal.

As used herein, the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C", and "A, B, and/or C" means A alone, B alone, C alone, A and B together, A and C together, B and C together, or A, B and C together.

Referring now to FIGS. 1A-13, a beverage container end closure and methods and devices for forming the same according to various embodiments of the present invention are shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

Figure 1B:
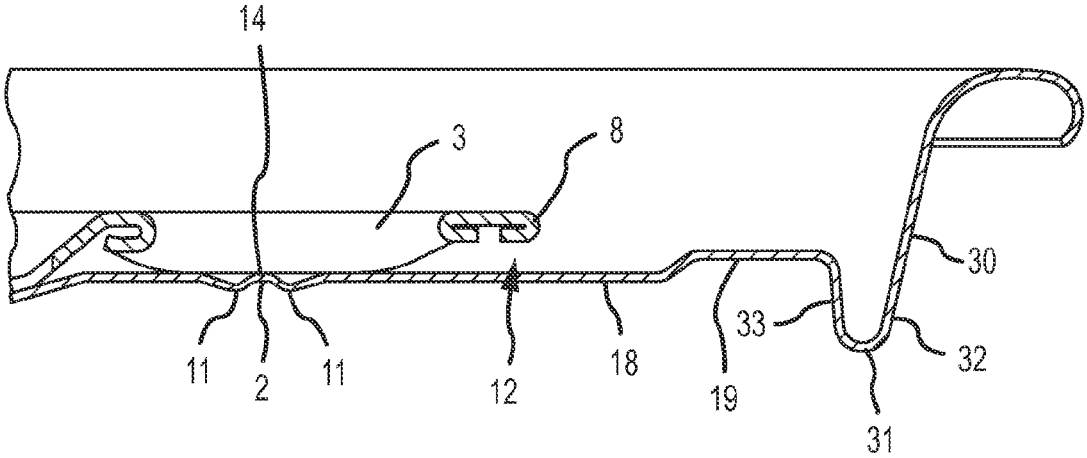
FIG. 1B is an enlarged cross-sectional view of FIG. 1A.

FIG. 1A depicts an embodiment of a loose, non-pressurized end closure 1 for a food or beverage container in a cross-sectional side view. The end closure 1 may have a protuberance 2 positioned under a tab 3. FIG. 1B is an enlarged view of the area labeled Detail Y in FIG. 1A. Referring to FIGS. 1A and 1B, the end closure 1 shown has not yet been interconnected to a pressurized container. The tab 3 is provided for selectively opening an opening area which is defined by a score line (not shown). The tab 3 may be secured to the end closure 1 through a variety of known devices and means including, for example, a rivet. The tab 3 may comprise a lift ring and a nose 15. The lift ring may comprise a tail 8, also referred to herein as the "tail of the lift ring," "lift ring tail," "tab tail," and "tail." The end closure 1 may also comprise a peripheral curl 5, chuck wall 30, countersink 31, countersink outer panel wall 32, countersink inner panel wall 33, and central panel 19 (also called a "central portion" herein). The central panel 19 may extend into the countersink 31, corresponding chuck wall 30, and peripheral curl 5 for attaching the end closure to a container (not shown). The central panel 19 may further comprise a deboss area 18 (also called a "debossed central portion" herein), protuberance 2, and protuberance slack area 11. In one embodiment, the height of the protuberance 2 above the deboss area 18 before pressurization is approximately 0.005 inches. In some embodiments, the protuberance has a cross-sectional elevation substantially the same as the deboss area before pressurization (i.e., in the protuberance's first position). In various embodiments, the end closure 1 comprises the debossed central portion 18 containing the tab 3 and opening area of the end closure 1. The tab 3 may contact the protuberance 2 at a tab contact area 14. Additionally, there may be space between the lift ring and the deboss area, such space referred to herein as the lift ring access area (before pressurization) 12.

Figure 2A:
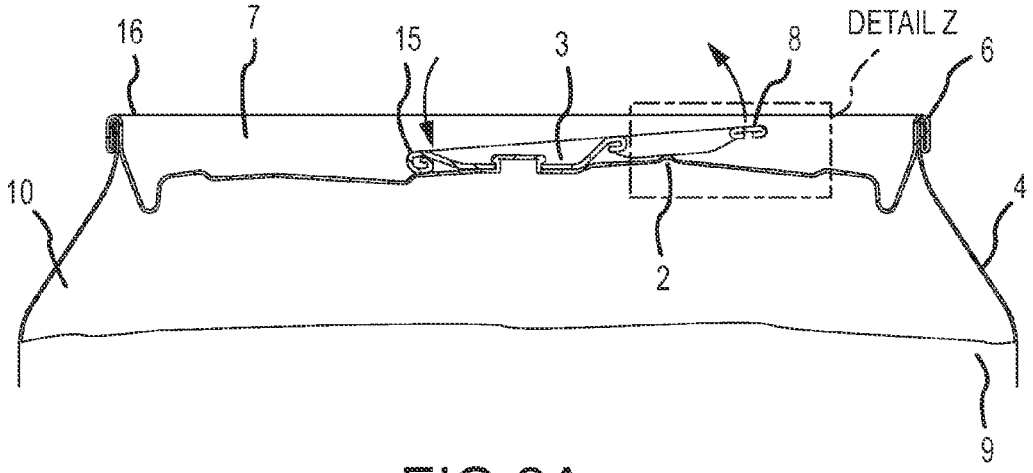
FIG. 2A is a cross-sectional front elevation view of an end closure with a protuberance and a tab double seamed on a pressurized container body.
Figure 2B:
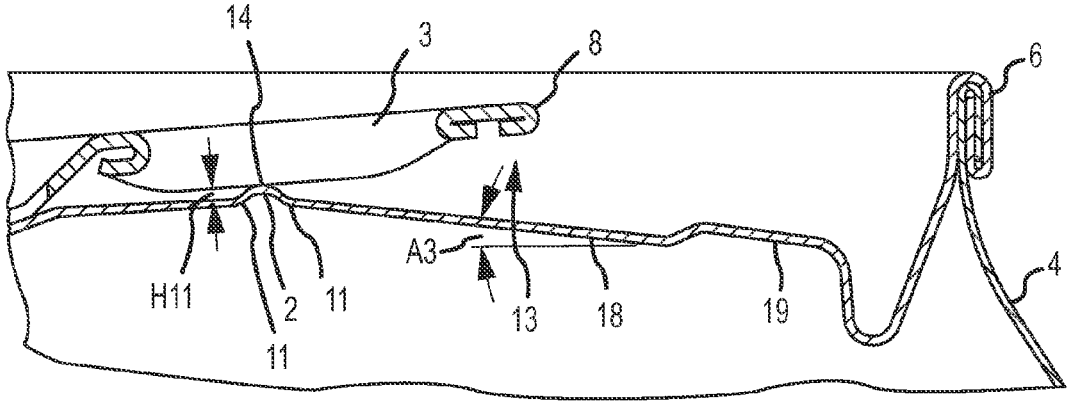
FIG. 2B is an enlarged cross-sectional view of FIG. 2A.

FIG. 2A shows a cross section of an embodiment of a pressurized end closure 7 with a protuberance 2 after it is seamed onto a pressurized container body 4. FIG. 2B is an enlarged view of the area labeled Detail Z in FIG. 2A. Referring to FIGS. 2A and 2B, the end closure 7 shown is the end closure of FIGS. 1A and 1B after it has been seamed onto a pressurized container. The container body 4 may comprise a pressurized product 9 and head space 10. The pressurized product 9 may be a carbonated beverage, pressurized food, or other pressurized beverage. After pressurization, the protuberance 2 pops up, protrudes, bulges, projects, or extends upward such that it pushes on an end of a tab 3 at a contact area 14. The tab 3 may comprise a nose 15 and a lift ring with a lift ring tail 8. The space under the lift ring is increased after the tab tail 8 is raised such that a lift ring access area after pressurization 13 is larger than the lift ring access area before pressurization (12 of FIG. 1B). In certain embodiments, the lift ring access area after pressurization 13 has a geometry adapted to receive a specific type of tool such as a church key, bottle opener, coin, etc. The end closure 7 may also comprise a seam 6, a chime 16, and a central panel 19. The central panel 19 may further comprise a deboss area 18, a deflectable protuberance 2, and a protuberance slack area 11. In various embodiments of the end closure 7 after pressurization, the protuberance 2 (i.e., the protuberance's second position) has a height, H11, above a corresponding deboss area 18. More preferably, H11 comprises a height of between approximately 0.040 inches and 0.020 inches. In a preferred embodiment, H11 comprises a height of approximately 0.030 inches. Further, the slack area 11 is reduced after pressurization and the protuberance 2 is deflected. The arrows in FIG. 2A show how the tab 3 rotates after the protuberance 2 is deflected. The protuberance 2 in FIGS. 1A-2B is placed approximately midway from the rivet to the tail of the lift ring 8.

In the non-seamed, nonpressurized state the end closure 1 remains flat allowing it to convey, stack and handle like a conventional end closure. After the end closure 7 is seamed on to the container body 4, the pressurized product 9 releases $CO_2$ and pressurizes the head space 10. The head space pressure bulges the protuberance 2 upward, which lowers the tab's nose 15, keeping it below chime 16, and lifts the lift ring tail 8 to create a lift ring access area 13 for the consumer's finger. The lift ring access area 13 aids in the ease of opening the end closure's aperture. In various embodiments, the deflectable protuberance 2 moves between a first position (before pressurization) and a second position (after pressurization, protuberance is deflected) when the pressure in the container is greater than about 35 psi. In a preferred embodiment, the deflectable protuberance 2 moves between a first position and a second position when the pressure in the container is greater than about 15 psi.

In a preferred embodiment, the protuberance 2 is sized and positioned such that a portion of the tab 3 extends over a portion of the area defined by a weakened area comprising the protuberance 2. In various embodiments, a protuberance 2 of the present invention comprises generally rounded or contoured features, such rounded edges or contours on the upper or public side of the end closure so as to reduce the risk of laceration to a user or other items, as well facilitate access to an underside of a tab 3.

It will be expressly recognized, however, that protuberances of the present invention may comprise any number of shapes. In one embodiment, the protuberance 2 may be circular. In another embodiment, the protuberance 2 may be ovoid shaped and comprise more than one radius of curvature.

In some embodiments, the tab 3 may not comprise a lift ring. Thus, the tab end opposite the tab nose 15 (e.g., the tab tail) may be one continuous piece without a hole. In other embodiments, the lift ring hole or cutout may be larger or smaller than shown in FIGS. 1A-7.

Figure 3:
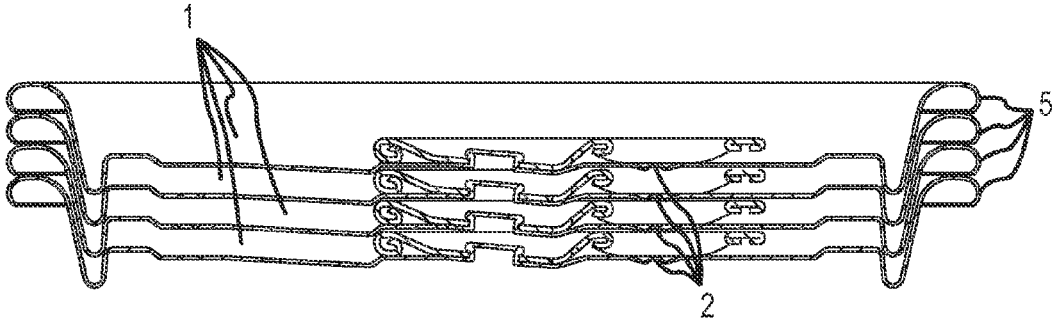
FIG. 3 is a cross-sectional front elevation view of four loose end closures with a protuberance and a tab stacked on top of one another.

FIG. 3 depicts a cross section of an embodiment of four loose, non-pressurized end closures 1 (each with a protuberance 2 and a peripheral curl 5) nested together without stacking interference. FIG. 3 shows that the embodiments of the present invention have advantages over the prior art during the manufacturing process. For example, the end closures of the various embodiments disclosed herein stack, convey, and palletize as well as traditional end closures without a protuberance. Additionally, the end closures of the various embodiments disclosed herein do not increase the likelihood of metal exposure, rotated tabs, and tab over chime issues.

Figure 4:
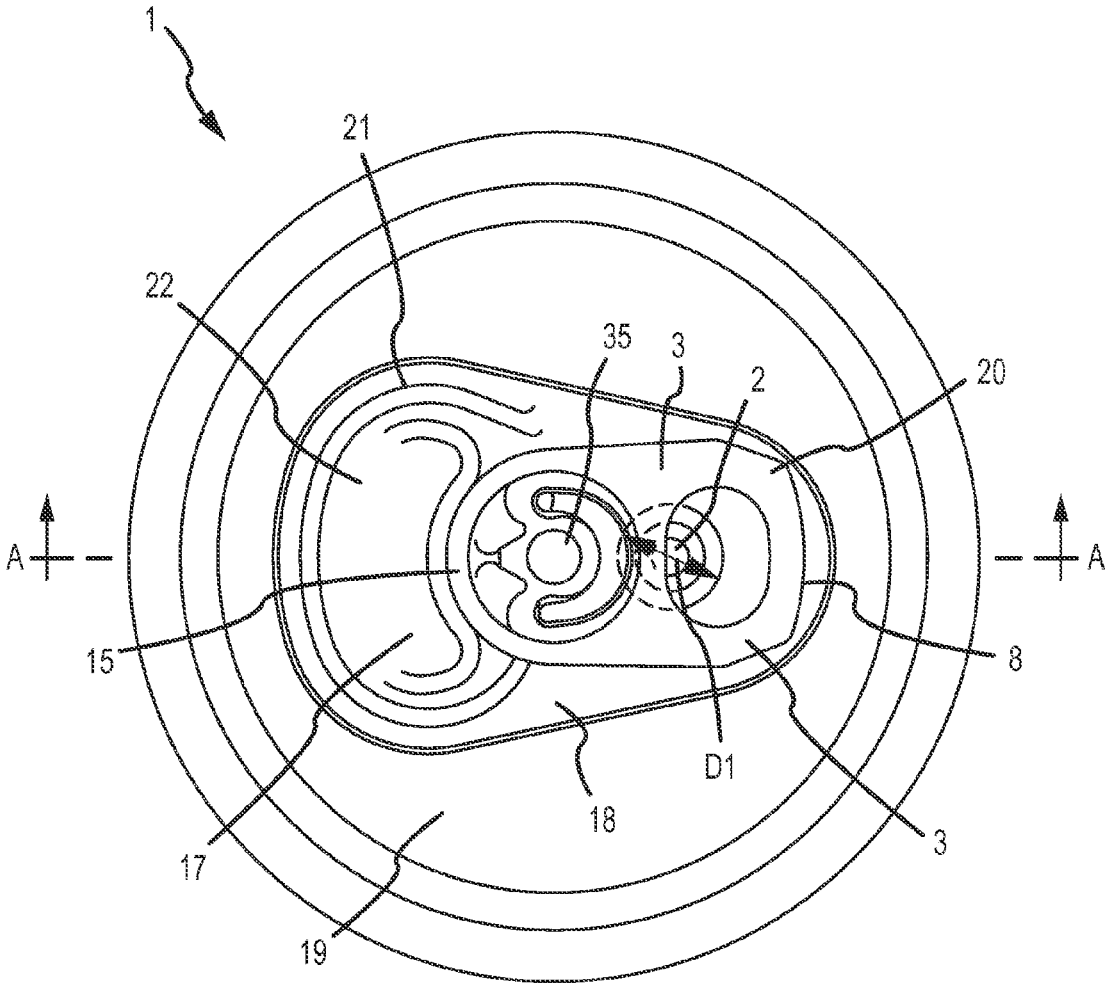
FIG. 4 is a top plan view of an end closure with a protuberance and a stay-on pull tab.

FIG. 4 shows the public side of an embodiment of an end closure 1 with a protuberance 2 and a tab 3. In various embodiments, a first diameter D1 comprises a diameter of the weakened area. Preferably, D1 comprises a diameter of between approximately 0.09 inches and 0.60 inches. More preferably, D1 comprises a diameter of between approximately 0.10 inches and 0.50 inches. In a preferred embodiment, D1 comprises a diameter of approximately 0.30 inches. In some embodiments, the tab 3 may comprise a nose 15 and a lift ring 20. The lift ring 20 may comprise a lift ring tail 8. In some embodiments, the tab 3 is interconnected to deboss area 18 of a central panel 19 using a rivet 35. The central panel 19 may further comprise a deboss area 18, a shadow bead 17, and a score line defining a perimeter of a pour opening 22. In various embodiments, the deboss area 18 may comprise multiple radii of curvature (not labeled). In some embodiments, the shadow bead 17 is positioned within the deboss area 18. The shadow bead 17 may have an inward (toward the inside of the container) orientation and is designed to reduce slack metal, draw excess metal or slack from the tear panel, increase stiffness of the tear panel, and improve the opening characteristics of the end closure.

Figure 5:
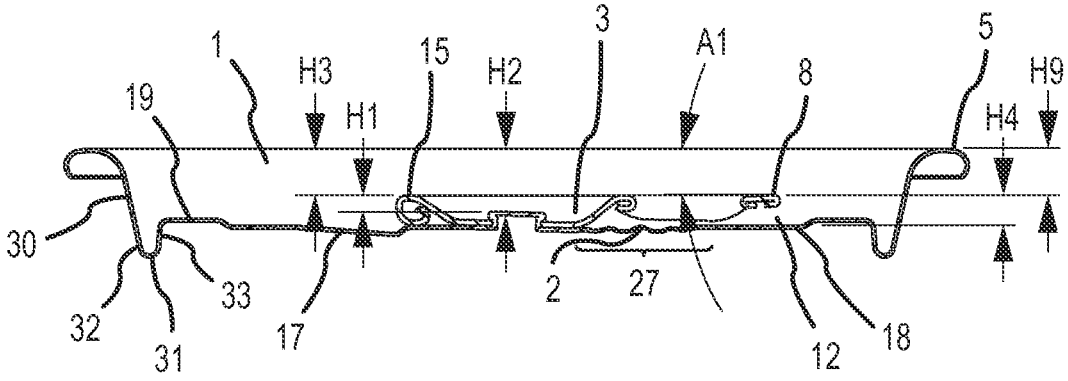
FIG. 5 is a cross-sectional view (cut at A-A of FIG. 4) of an embodiment of a loose, non-pressurized end closure with a protuberance and a tab.

FIG. 5 shows a cross section (at cut A-A of FIG. 4) of a loose, non-pressurized end closure 1. The end closure 1 may comprise a protuberance 2 positioned below a pull tab 3. The tab 3 may comprise a nose 15 and a lift ring with a lift ring tail 8. The space under the lift ring is labeled as 12 and may be referred to as a lift ring access area before pressurization 12. The end closure 1 may also comprise a peripheral curl 5, chuck wall 30, countersink 31, countersink outer panel wall 32, countersink inner panel wall 33, and central panel 19. The central panel 19 may further comprise a deboss area 18, a shadow bead 17, the deflectable protuberance 2, and a weakened area 27.

In FIG. 5 the angle of the top surface of the tab 3 relative to the top surface of the peripheral curl 5 before pressurization is labeled as A1. In various embodiments, A1 comprises an angle between approximately −0.5 degrees and 1.0 degree. More preferably, A1 comprises an angle between approximately 0.0 degrees and 0.5 degrees. In a preferred embodiment, A1 comprises an angle of approximately 0.25 degrees. The distance between the top surface of the nose 15 of the pull tab 3 and the top surface of the rivet, before pressurization, is labeled as H1. In various embodiments, H1 comprises a distance between approximately 0.02 inches and 0.06 inches. More preferably, H1 comprises a distance between approximately 0.030 inches and 0.045 inches. In a preferred embodiment, H1 comprises a distance approximately 0.038 inches. The distance between the top of the peripheral curl 5 and the top surface of the rivet, before pressurization, is labeled as H2. In various embodiments, H2 comprises a distance between approximately 0.100 inches and 0.200 inches. More preferably, H2 comprises a distance between approximately 0.150 inches and 0.175 inches. In a preferred embodiment, H2 is approximately 0.164 inches. The distance between the top of the peripheral curl 5 and the top surface of the nose 15 of the pull tab 3, before pressurization, is labeled as H3. In various embodiments, H3 comprises a distance between approximately 0.040 inches and 0.180 inches. More preferably, H3 comprises a distance between approximately 0.110 inches and 0.140 inches. In a preferred embodiment, H3 is approximately 0.125 inches. The distance between the top surface of the deboss area 18 of the central panel 19 and the top surface of the tab 3, before pressurization, is labeled as H4. In various embodiments, H4 comprises a distance between approximately 0.030 inches and 0.100 inches. More preferably, H4 comprises a distance between approximately 0.050 inches and 0.085 inches. In a preferred embodiment, H4 is approximately 0.070 inches. The distance between the top of the peripheral curl 5 and the top surface of the top surface of the lift ring tail 8, before pressurization, is labeled as H9. In various embodiments, H9 comprises a distance between approximately 0.040 inches and 0.180 inches. More preferably, H9 comprises a distance between approximately 0.110 inches and 0.140 inches. In a preferred embodiment, H9 is approximately 0.125 inches.

Figure 6:
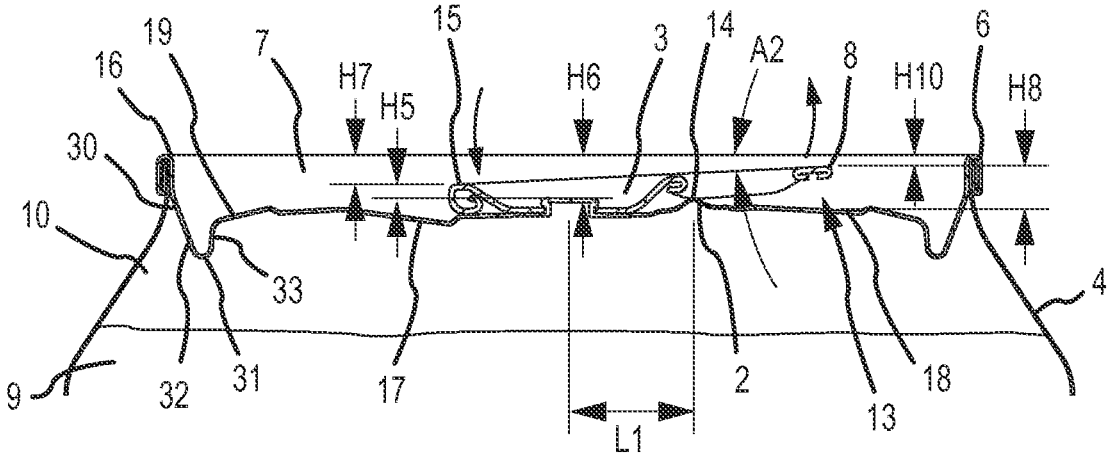
FIG. 6 is a cross-sectional view (cut at A-A of FIG. 4) of an embodiment of an end closure with a protuberance and a tab seamed on to a beverage container body and pressurized.

FIG. 6 is a side view of a cross section (at cut A-A of FIG. 4) of a pressurized end closure 7 seamed to a container body 4. In various embodiments, the container body 4 may comprise a pressurized product 9 and head space 10. The pressurized product 9 may be a carbonated beverage, pressurized food, or other pressurized beverage. The end closure 7 may comprise a protuberance 2 positioned below a pull tab 3. In the embodiment depicted, the protuberance 2 is engaging the tab 3. The tab 3 may contact the protuberance 2 at a tab contact area 14. In some embodiments, the tab 3 may comprise a nose 15 and a lift ring with a lift ring tail 8. The space under the lift ring is labeled as 13 and may be referred to as a lift ring access area after pressurization 13. The end closure 7 may also comprise a chime 16, seam 6, chuck wall 30, countersink 31, countersink outer panel wall 32, countersink inner panel wall 33, and central panel 19. The central panel 19 may further comprise a deboss area 18, a shadow bead 17, and the deflectable protuberance 2.

In FIG. 6, the angle of the top surface of the tab 3 relative to the chime 16 after pressurization is labeled as A2. In various embodiments, A2 comprises an angle between approximately 0.0 degrees and 5.0 degrees. More preferably, A2 comprises an angle between approximately 0.5 degrees and 4.0 degrees. In a preferred embodiment, A2 comprises an angle of approximately 3.0 degrees. The distance between the top surface of the nose 15 of the pull tab 3 and the top surface of the rivet, after pressurization, is labeled as H5. In various embodiments, H5 comprises a distance between approximately 0.01 inches and 0.05 inches. More preferably, H5 comprises a distance between approximately 0.025 inches and 0.040 inches. In a preferred embodiment, H5 comprises a distance approximately 0.035 inches. The distance between the chime 16 and the top surface of the rivet, after pressurization, is labeled as H6. H6 is smaller than H2 (the corresponding distance before pressurization) because the pressure pushes the end closure upward or lifts the end closure. In various embodiments, H6 comprises a distance between approximately 0.025 inches and 0.180 inches. More preferably, H6 comprises a distance between approximately 0.100 inches and 0.125 inches. In a preferred embodiment, H6 is approximately 0.113 inches. The distance between the chime 16 and the top surface of the nose 15 of the pull tab 3, after pressurization, is labeled as H7. In various embodiments, H7 comprises a distance between approximately 0.06 inches and 0.10 inches. More preferably, H7 comprises a distance between approximately 0.07 inches and 0.09 inches. In a preferred embodiment, H7 is approximately 0.080 inches. The distance between the deboss area 18 of the central panel 19 and the top surface of the lift ring tail 8, after pressurization, is labeled as H8. In various embodiments, H8 comprises a distance between approximately 0.07 inches and 0.15 inches. More preferably, H8 comprises a distance between approximately 0.09 inches and 0.13 inches. In a preferred embodiment, H8 is approximately 0.11 inches. The distance between the chime 16 and the top surface of the lift ring tail 8, after pressurization, is labeled as H10. In various embodiments, H10 comprises a distance between approximately 0.01 inches and 0.04 inches. More preferably, H10 comprises a distance between approximately 0.02 inches and 0.03 inches. In a preferred embodiment, H10 is approximately 0.025 inches. The horizontal distance between the centerline of the rivet and the center of the protuberance, after pressurization, is labeled as L1. In various embodiments, L1 comprises a distance between approximately 0.15 inches and 0.50 inches. More preferably, L1 comprises a distance between approximately 0.30 inches and 0.34 inches. In a preferred embodiment, L1 is approximately 0.32 inches. The additional curved arrows in FIG. 6 depict how the tab 3 rotates after the protuberance 2 is deflected.

Figure 7:
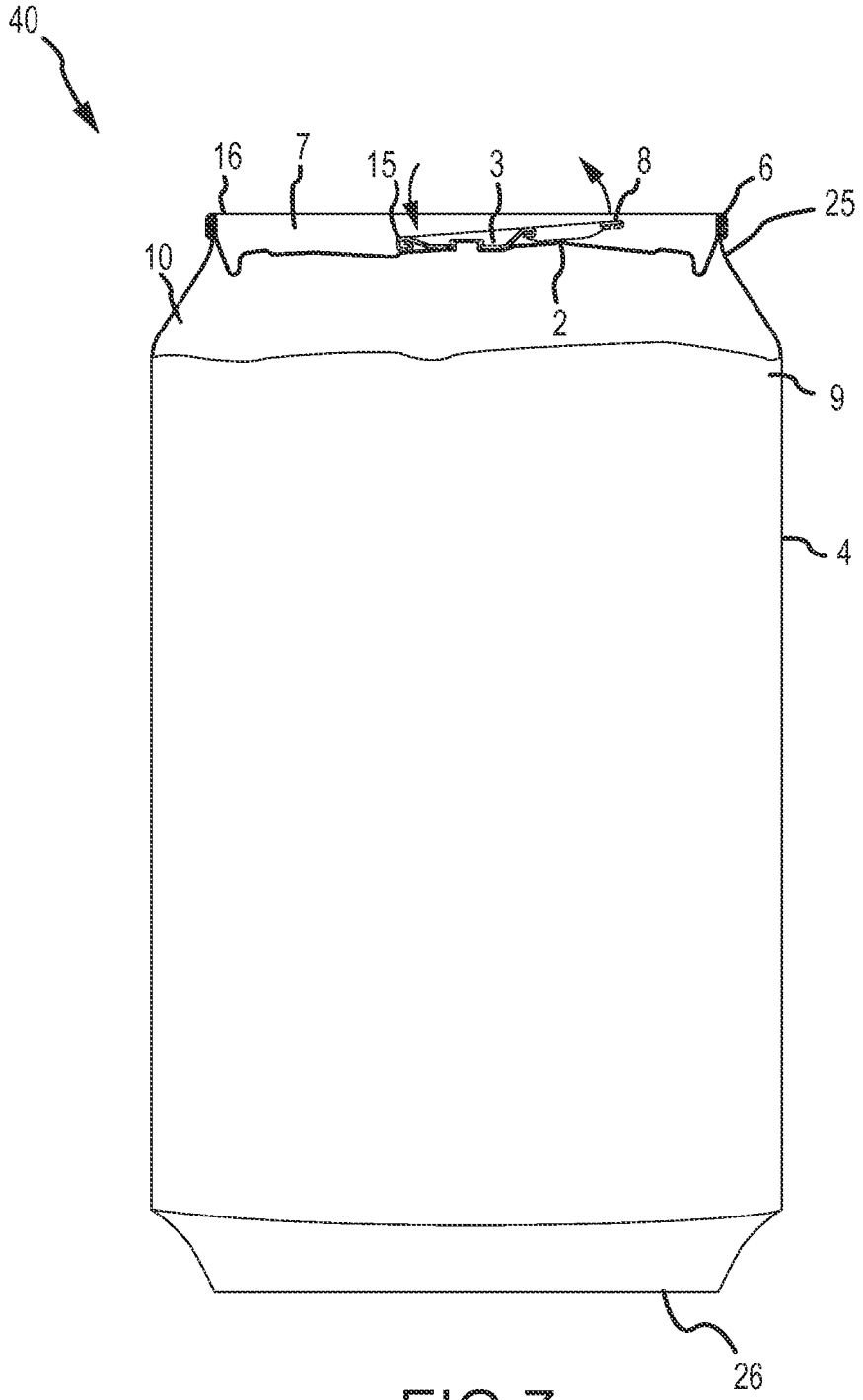
FIG. 7 is a cross-sectional view (cut at A-A of FIG. 4) of an embodiment of an end closure seamed on to a pressurized container body.

FIG. 7 is a side view of a cross section of an embodiment of a sealed and pressurized beverage container 40. The beverage container may comprise a pressurized end closure 7 seamed to a neck 25 of a container body 4. In various embodiments, the container body 4 may comprise a pressurized product 9, head space 10, and a closed lower end 26. The end closure 7 may comprise a protuberance 2 positioned below a pull tab 3. In some embodiments, the tab 3 may comprise a nose 15 and a lift ring with a lift ring tail 8. In the embodiment depicted, the protuberance 2 is engaging the tab 3 such that the tail 8 of the lift ring is lifted. The end closure 7 may also comprise a chime 16 and a seam 6. The curved arrows in FIG. 7 depict how the tab 3 rotates after the protuberance 2 is deflected.

With respect to FIGS. 8-13, the public sides of the end closures are depicted and they are shown without a tab for clarity. Additionally, one contour feature commonly used on end closures to reduce metal slack is a raised curvilinear ridge generally referred to as a "bead." It is known to use high-relief beads having a variety of geometric configurations, including a non-closed curve resembling the letter "C" (sometimes called a "C-bead"), a closed curve having one straight side resembling the letter "D" (sometimes called a "D-bead"), a closed curve of circular or oval shape, or an irregular closed or non-closed shape. It must be noted that although beads are among the most common high-relief contour features found on end closures, other high-relief contour features are also known, including ridges, panels, embossments, and various combinations of these features. It was heretofore believed necessary to incorporate high-relief contour features on the end closures of stay-on-tab containers for one or more of the following reasons: 1) to serve as lateral stiffening or reinforcing structures on the end closure so that the panel will not bow excessively or buckle during the opening operation, which can cause "nose failure" and "tuck-under" type failures; 2) to selectively distribute the forces of the opening tab across the tear panel to propagate the fracturing of the score line completely around the tear panel so the panel will not experience an "partial opening" type failure; and 3) to gather in the "slack metal" on the end closure which results from the widening of the panel during formation of the score lines, thereby maintaining tension in the tear panel, the lack of which can also cause nose failure, tuck-under type failure, or partial opening type failure. Note that "tear panel" may be used interchangeably herein with "opening" or "pour opening." A "nose failure" occurs when there is excessive bowing or buckling of the tear panel due to insufficient stiffness or insufficient tension that allows the tab end to slip along the surface of the tear panel without rupturing the score line at all. A "tuck-under" type failure, also known as a "non-turn-under" type failure, occurs when the same factors cause the tab to only partially rupture the score line and not displace the tear panel far enough into the container to provide a useable opening. A "partial opening" type failure, also known as an "insufficient angle" type failure occurs when the score line fully ruptures, but bowing of the tear panel or inadequate distribution of tab forces prevents the tab from displacing the tear panel through a sufficient angle into the container to avoid obstructing the opening.

Other contour features known in the art may be used in the embodiments disclosed herein, including beads having various configurations, when viewed from above, beads having various other profiles (for example, semicircular), when viewed in cross section, and other contour features such as embossments and panels.

The embodiments shown in FIGS. 8-13 comprise one or more forms, one or more cent beads, and/or a combination of a form and a cent bead. The cent bead is provided to remove slack metal in the central panel proximate to and around the rivet area (also known as "puckering"), which diminishes the effectiveness of the pull tab during opening. Cent beads similar to those disclosed in U.S. Patent Application Pub. No. 2004/0056032, which is incorporated herein by reference in its entirety, may be used in some embodiments. Additionally, the form may also remove slack metal in the central panel.

In one embodiment, the form on the end closure is provided to slightly lift a pull tab tail and may function similarly to the protuberance described above. The form may be located below a pull tab and pushes the tab tail upward and away from the central panel allowing for ease of access to the operative (i.e., bottom) side of the tab, thereby increasing user-friendliness of the end closure. In one embodiment, the form may be manufactured in an extended position such that the form is extended before the end closure is seamed onto a container. The form may further extend upward with the end closure after the end closure is seamed onto a pressurized container and push the tail of the pull tab upward. In an alternate embodiment, the form may be flat, i.e., substantially the same height as the central panel, during manufacturing and may extend upward after the end closure is seamed onto a pressurized container.

FIG. 8 is a top plan view of one embodiment of an end closure with a protuberance 2 and a cent bead 38. FIG. 8 depicts a preferred embodiment of the arrangement of the protuberance with respect to the other features of the end closure (e.g., a cent bead, score lines, deboss area, countersink, etc.). The outer circle of the protuberance 2 marks the outer edge of the weakened area. The inner circles of the protuberance depict different contour levels. It will be expressly recognized that variations of the embodiment shown in FIG. 8, particularly with respect to the location and shape of the protuberance, are expressly contemplated as within the scope and spirit of the present disclosure.

FIG. 9 is a top plan view of an embodiment of an end closure of the present invention. In some embodiments, the end closure comprises a central panel for interconnection to a tab (not shown). If a tab were shown in FIG. 9, the nose of the tab would be positioned proximate score lines at the lower portion of the end closure and the lift ring would be on the opposite side of a rivet. The central panel may comprise a deboss area 17. The deboss area 17 may transition from an outer portion of the central panel to the deboss area 17 through a deboss angled wall 23. In some embodiments, the deboss angled wall 23 may be angled or sloped at one or more angles and may interconnect the lowermost portion (e.g., the deboss area) to the central panel. In the depicted embodiment, deboss angled wall 23 comprises one or more deboss wall interruptions 24 comprising different slopes or angles adjoining the deboss area 17 to the central panel. The deboss area 17 may also comprise one or more forms 36, one or more cent beads 38, score lines, and a rivet. When the end closure is seamed onto a pressurized container, the central panel of the end closure rises upward under pressure. In one embodiment, the central panel rises the most at a point proximate a center point of the central panel (meaning that the difference in the height of the center point relative to the chime before pressurization and the height after pressurization is greatest at the center point). In some embodiments, the tab is positioned such that a portion of the lift ring is above a portion of each form 36. When the central panel rises, so do the forms 36, which push on the lift ring or tail of the tab at a contact area or a contact point and lift the lift ring or tail of the tab in a similar manner as the protuberance described above. Thus, the area under the lift ring is increased after pressurization, making it easier for a user to access the lift ring and open the container.

FIG. 10 is a top plan view of the public side of one embodiment of an end closure. In some embodiments, the end closure comprises a central panel for interconnection to a tab (not shown). If a tab were shown in FIG. 10, the nose of the tab would be positioned proximate score lines at the lower portion of the end closure and the tab lift ring would be on the opposite side of a rivet than the nose. The central panel may also comprise a deboss area. The deboss area may transition from an outer portion of the central panel to the deboss area through a deboss angled wall. In some embodiments, the deboss angled wall may be angled or sloped at one or more angles and may interconnect the lowermost portion (e.g., the deboss area) to the central panel. The deboss area may also comprise a form 36, a cent bead 38, score lines, and a rivet. When the end closure is seamed onto a pressurized container, the central panel of the end closure rises upward under pressure. In one embodiment, the central panel rises the most at a point proximate a center point of the central panel (meaning that the difference in the height of the center point relative to the chime before pressurization and the height after pressurization is greatest at the center point). In some embodiments, the tab is positioned such that a portion of the lift ring is above a portion of the form 36. When the central panel rises, so does the form 36, which pushes on the lift ring or tail of the tab at a contact area or a contact point and lifts the lift ring of the tab in a similar manner as the protuberance described above. Thus, the area under the lift ring is increased after pressurization, making it easier for a user to access the lift ring and open the container.

FIG. 11 is a top plan view of the public side of one embodiment of an end closure. In some embodiments, the end closure comprises a central panel for interconnection to a tab (not shown). If the tab were shown in FIG. 11, the nose of the tab would be positioned proximate score lines at the lower portion of the end closure and the tab lift ring would be on an opposite side of a rivet than the nose. The central panel may also comprise a deboss area. The deboss area may transition from an outer portion of the central panel to the deboss area through a deboss angled wall. In some embodiments, the deboss angled wall may be angled or sloped at one or more angles and may interconnect the lowermost portion (e.g., the deboss area) to the central panel. The deboss area may also comprise a feature that is a combination of a cent bead and a form 39, score lines, and a rivet. When the end closure is seamed onto a pressurized container, the central panel of the end closure rises upward under pressure. In some embodiments, the tab is positioned such that a portion of the lift ring is above a portion of the combination of cent bead and form 39. When the central panel rises, so does the combination of cent bead and form 39, which pushes on the lift ring or tail of the tab at a contact area and lifts the lift ring in a similar manner as the protuberance described above. Thus, the area under the lift ring is increased after pressurization, making it easier for a user to access the lift ring and open the container.

FIG. 12 is a top plan view of the public side of an embodiment of an end closure. In some embodiments, the end closure comprises a central panel for interconnection to a tab (not shown). If a tab were shown in FIG. 12, the nose of the tab would be positioned proximate score lines at the lower portion of the end closure and the tab lift ring would be on an opposite side of a rivet than the nose. The central panel may also comprise a deboss area. The deboss area may comprise one or more forms 36, a cent bead 38, score lines, and a rivet. When the end closure is seamed onto a pressurized container, the central panel of the end closure rises upward under pressure. In some embodiments, the tab is positioned such that a portion of the lift ring is above a portion of the forms 36 and the cent bead 38. When the central panel rises, so do the forms 36 and the cent bead 38, which both push on the lift ring at contact areas or contact points and lift the lift ring in a similar manner as the protuberance described above. Thus, the area under the lift ring is increased after pressurization, making it easier for a user to access the lift ring and open the container.

FIG. 13 is a top plan view of an embodiment of an end closure. In some embodiments, the end closure comprises a central panel for interconnection to a tab (not shown). If a tab were shown in FIG. 13, the nose of the tab would be positioned proximate score lines at the lower portion of the end closure and the tab lift ring would be on an opposite side of a rivet 35 than the nose. The central panel may also comprise a deboss area. The deboss area may comprise a form 36, a cent bead 38, score lines, and a rivet 35. When the end closure is seamed onto a pressurized container, the central panel of the end closure rises upward under pressure. In some embodiments, the tab is positioned such that a portion of the lift ring is above a portion of the form 36 and the cent bead 38. When the central panel rises due to pressure in the container, so does the form 36, which pushes on the lift ring at an end closure contact area 37 and lifts the lift ring in a similar manner as the protuberance described above. Thus, the area under the lift ring is increased after pressurization, making it easier for a user to access the lift ring and open the container.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. An end closure for a beverage container with an improved access pull tab, comprising:

a peripheral curl adapted for interconnection to a neck of the container;

a chuck wall interconnected to said peripheral curl and extending downwardly therefrom;

a countersink having an outer panel wall interconnected to a lowermost portion of said chuck wall and an inner panel wall;

a central panel interconnected to said inner panel wall and oriented in a substantially horizontal plane and having a substantially vertical center axis;

a pull tab interconnected to an exterior surface of said central panel at an interconnection point, said pull tab including a lift ring and a nose on an end opposite the lift ring, said nose positioned proximate to a frangible score line in said central panel which defines a pour opening; and a deflectable protuberance in said central panel which is positioned below said pull tab between said interconnection point and a distal end of said lift ring, said deflectable protuberance having an apex with a height substantially the same as said central panel in a first position prior to deflection and said deflectable protuberance having said apex raised relative to said central panel in a second position after deflection which elevates said lift ring of said pull tab to provide improved access for a user's fingers below said lift ring.

2. The end closure of claim 1, wherein said deflectable protuberance is elevated at least about 0.020 inches in said second position when compared to said first position.

3. The end closure of claim 1, wherein said deflectable protuberance is defined by a substantially circular shaped perimeter.

4. The end closure of claim 1, wherein said deflectable protuberance moves between said first position and said second position when a pressure below said deflectable protuberance is at least about 15 psi.

5. The end closure of claim 1, wherein said pull tab is positioned at an angle of between about zero and four degrees from a horizontal plane when said deflectable protuberance is in said second position.

6. The end closure of claim 1, wherein said pull tab is interconnected to said central panel with a rivet.

7. The end closure of claim 1, wherein said chuck wall is inclined between said peripheral curl and said outer panel wall of said countersink at an angle between about 10 and 50 degrees.

8. The end closure of claim 1, wherein said deflectable protuberance contacts said pull tab at a contact area.

9. The end closure of claim 1, further comprising slack metal surrounding said deflectable protuberance when said deflectable protuberance is in said first position.

10. A metallic beverage container with a dynamic stay on tab, comprising:

a container body having a closed lower end and an open upper end with a neck;

a metallic end closure adapted for interconnection to the neck of the container, said metallic end closure having a substantially vertical center axis when viewed in cross-section, and oriented in a substantially horizontal plane when in a first position;

a pull tab interconnected at an interconnection point to a central panel of said metallic end closure and comprising a lift ring on one end and a nose on an opposite end, said nose positioned proximate to a frangible score line in said central panel, said frangible score line defining at least a portion of a pour opening; and a deflectable protuberance formed in said central panel and positioned below said pull tab between a distal end of said lift ring and said pull tab interconnection point, said deflectable protuberance extending upwardly to elevate said lift ring of said pull tab after at least one of a food and a beverage is placed in said container and said metallic end closure is interconnected to said neck of said container, wherein an entire area of said deflectable protuberance is positioned within an outer perimeter of said pull tab.

11. The metallic beverage container of claim 10, wherein said deflectable protuberance extends upwardly at least about 0.020 inches.

12. The end closure of claim 10, wherein said pull tab is interconnected to an outer surface of said central panel with a rivet.

13. The metallic beverage container of claim 10, wherein said deflectable protuberance is positioned approximately midway between a rivet and the lift ring of said pull tab.

14. The metallic beverage container of claim 10, wherein said deflectable protuberance is positioned approximately 0.320 inches from a center point of a rivet.

15. The metallic beverage container of claim 10, wherein said deflectable protuberance extends upwardly when a pressure in said container is at least about 15 psi.

16. A method of forming and filling an improved access pull tab and container, comprising:

providing a container comprising a body having a closed lower end and an open upper end with a neck;

providing an end closure comprising a pull tab interconnected to a central panel, a deflectable protuberance formed in said central panel and positioned below said pull tab, a protuberance slack area positioned around at least a portion of said deflectable protuberance and positioned below said central panel and below an apex of said deflectable protuberance, and a frangible score line defining a perimeter of an opening, said pull tab comprising a lift portion on one end and a nose on an opposite end, said nose oriented proximate to a frangible score line in said central panel, wherein a top surface of said pull tab is parallel to a chime of said end closure;

filling said container with a carbonated beverage;

attaching said end closure to said neck of said container;

increasing a pressure in said container to create a force below said deflectable protuberance; and expanding said deflectable protuberance upward to raise said lift portion of said pull tab such that said top surface of said pull tab is positioned at an acute angle relative to said chime of said end closure.

17. The method of claim 16, wherein said end closure further comprises an interconnection point where said pull tab is interconnected to said central panel, and said deflectable protuberance is positioned between said interconnection point and lift portion.

18. The method of claim 16, further comprising expanding said deflectable protuberance upwardly at least about 0.020 inches.

19. The method of claim 16, further comprising providing slack metal around said deflectable protuberance, said slack metal expanding upwardly when said deflectable protuberance expands upwardly.

20. The method of claim 16, further comprising positioning said pull tab at an angle of between about one degree and four degrees from a horizontal plane after raising said lift portion of said pull tab.

* * * * *